US007014376B2

(12) United States Patent
Maruyama et al.

(10) Patent No.: US 7,014,376 B2
(45) Date of Patent: Mar. 21, 2006

(54) THERMAL PRINTER

(75) Inventors: Takahito Maruyama, Fukushima-ken (JP); Takashi Onozato, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 89 days.

(21) Appl. No.: 10/759,402

(22) Filed: Jan. 16, 2004

(65) Prior Publication Data

US 2004/0144267 A1 Jul. 29, 2004

(30) Foreign Application Priority Data

Jan. 20, 2003 (JP) ..... 2003-010642

(51) Int. Cl.
*B41J 2/315* (2006.01)

(52) U.S. Cl. ..... 400/120.01; 400/55; 400/59; 400/120.16; 400/120.17

(58) Field of Classification Search ..... 400/120.01–120.05, 120.16, 120.17, 55–59
See application file for complete search history.

(56) References Cited

U.S. PATENT DOCUMENTS 4,750,880 A * 6/1988 Stephenson et al. ... 400/120.16
5,030,968 A * 7/1991 Benson et al. ..... 347/222
5,230,574 A * 7/1993 Namekawa ..... 400/120.16
5,541,635 A * 7/1996 Wills et al. ..... 347/197
5,565,905 A * 10/1996 Kajiya et al. ..... 347/222
5,886,725 A * 3/1999 Miyadera et al. ..... 347/197

FOREIGN PATENT DOCUMENTS

| | | |
|---|---|---|
| JP | 05-309907 | 11/1993 |
| JP | 2002-079701 | 3/2002 |
| JP | 2002-120446 | 4/2002 |

* cited by examiner

*Primary Examiner*—Andrew H. Hirshfeld
*Assistant Examiner*—Dave A. Ghatt
(74) *Attorney, Agent, or Firm*—Brinks Hofer Gilson & Lione

(57) ABSTRACT

The present invention provides a thermal printer in which, even if a pair of head supporting members for supporting a thermal head composed of a line head has a positional error, the thermal head can be automatically adjusted to uniformly pressure-contact with a platen roller. A rotation supporting portion of a head supporting member is formed in a hole shape elongated in a direction parallel to a direction where a thermal head contacts with or separates from a platen roller. One end of each of the head supporting members is supported by a main body case so as to be movable in a direction parallel to the direction where the thermal head contacts with or separates from the platen roller.

4 Claims, 3 Drawing Sheets

THERMAL PRINTER

This application claims the benefit of priority to Japanese Patent Application No. 2003-010642, herein incorporated by reference.

BACKGROUND OF THE INVENTION

1. Field of the Invention

The present invention relates to a thermal printer suitable for printing on recording media by selectively generating heat from a plurality of heating elements of a thermal head on the basis of printing information.

2. Description of the Related Art

A heat transfer printer will now be described as a conventional thermal printer. Referring to FIG. 5, in the thermal printer 51, a paper guide plate 52*b* is formed in a slanted direction on the right side of a bottom plate 52*a* of a main body case 52, and recording media 53 can be fed in the direction of arrow A on the paper guide plate 52*b*.

In addition, a cylindrical platen roller 54 is rotatably provided on the left side of the paper guide plate 52*b*.

A thermal head 55 composed of a line head is provided on the upper side of the platen roller 54 to be opposite thereto.

The thermal head 55 is fixed to a head mount 56, and the head mount 56 is mounted on a head lever 57.

A circular supporting hole 57*a* is formed at one end of the right side of the head lever 57, and the other end of the head lever 57, on which the thermal head 55 has been mounted, can rotate using the supporting hole 57*a* as a shaft.

A pair of head levers 57 is provided to face each other and supports both ends of the head mount 56 on which the thermal head 55 is mounted.

Side plates 52*c* are provided in the main body case 52 to face each other, and the supporting holes 57*a* are supported by supporting shafts 58 fixed to the side plates 52, so that the head levers 57 can rotate.

The thermal head 55 is lifted or lowered by allowing the head levers 57 to rotate in the up and down directions with the supporting holes 57*a* as shafts and thus contact with or separates from the platen roller 54.

A paper transfer roller 60 and a pressure roller 61, which comes into pressure contact with the paper transfer roller 60, are provided on the lower side of the platen roller 54 in the feeding direction of arrow A. The pressure roller 61 is rotatably supported to a roller supporting case 62.

An ink ribbon 63 is wound up between the platen roller 54 and the thermal head 55 in a head-up state. The ink ribbon 63 is accommodated in a ribbon cassette 64 with both its ends wound up on a winding core 65 and a supply core 66, respectively.

In addition, the winding core 65 and the supply core 66 are engaged with a winding bobbin 67 and a supply bobbin 68 provided on one side plate 52*c* of the main body case 52, respectively.

A paper discharge roller 69 for discharging recording media 53 after printing is provided on the lower side of the winding core 65 in the feeding direction of arrow A.

The printing operation of a conventional thermal printer 51 will now be explained. The head levers 57 rotate upwardly to lift the thermal head 55, and the ribbon cassette 64 is mounted thereto.

Then, the recording media 53 is fed between the thermal head 55 in a head-up state and the platen roller 54 in the direction of arrow A.

The recording media 53 passing between the thermal head 55 and the platen roller 54 is sandwiched between the paper transfer roller 60 and the pressure roller 61, and the thermal head 55 is lowered.

A plurality of heating elements of the thermal head 55 makes pressure contact with the outer circumferential surface of the platen roller 54 with the recording media 53 and the ink ribbon 63 interposed therebetween.

Thereafter, the heating elements of the thermal head 55 are selectively made to generate heat on the basis of printing information, and the paper transfer roller 60 is rotated in a counterclockwise direction to feed the recording media 53 in the direction of arrow A. Accordingly, the desired color images are printed on the recording media 53.

In addition, the recording media 53, which passes between the paper transfer roller 60 and the pressure contact roller 61 after printing, is externally discharged by the paper discharge roller 69 rotating in the counterclockwise direction.

[Patent Document 1]

Japanese Unexamined Patent Application Publication No. 2002-79701

Japanese Unexamined Patent Application Publication No. 2002-120446

However, in the aforementioned conventional thermal printer 51, positional errors of the supporting holes 57*a* of the pair of head levers 57 or the thermal head 55 in the up and down directions may occur due to a difference in size between the head levers 57 or faults in assembly.

When the circular supporting holes 57*a* of the head levers 57 having such positional errors are supported by the supporting shafts 58, both sides of a long thermal head 55 are inclined in the up and down directions, and thus the thermal head 55 inclines in the longitudinal direction of the platen roller 54. Therefore, it was determined that the thermal head 55 could not uniformly make pressure contact with the platen roller 54.

Furthermore, when the thermal head 55 does not uniformly make pressure contact with the platen roller 54, printing quality on the recording media 53 can deteriorate.

SUMMARY OF THE INVENTION

The present invention is designed to solve the aforementioned problems. It is an object of the invention to provide a thermal printer which allows a thermal head composed a line head to uniformly make pressure contact with a platen roller by automatically adjusting the thermal head even if a pair of head supporting members for supporting the thermal head has a positional error.

As a first aspect for solving the problems, a thermal printer of the present invention includes a platen roller whose shaft is rotatably supported to a main body case, a thermal head composed of a long line head and capable of contacting with or separating from the platen roller, and a pair of head supporting members for supporting both ends of the thermal head in the longitudinal direction, wherein one end of each of the head supporting members supporting the thermal head is rotatable using a rotation supporting portion formed at the other end thereof as a rotation point, and wherein at least one of the rotation supporting portions of the pair of head supporting members is formed in a hole shape elongated in a direction parallel to a direction where the thermal head contacts with or separates from the platen roller.

As a second aspect for solving the problems, the rotation supporting portions are supported by supporting shafts fixed to the main body case.

As a third aspect for solving the problems, the thermal head is pressure-contacted to the platen roller by the elastic force applied from an elastic member to the head supporting members.

As a fourth aspect for solving the problems, inner surfaces of the elongated hole shaped rotation supporting portion facing each other in the longitudinal direction are formed in a circular arc shape whose the center is a contact point of the thermal head and the platen roller.

BRIEF DESCRIPTION OF THE DRAWINGS

The above and other features and advantages of the present invention will become more apparent by describing in detail exemplary embodiments thereof with reference to the accompanying drawings in which.

DESCRIPTION OF THE PREFERRED EMBODIMENT

Figure 1:
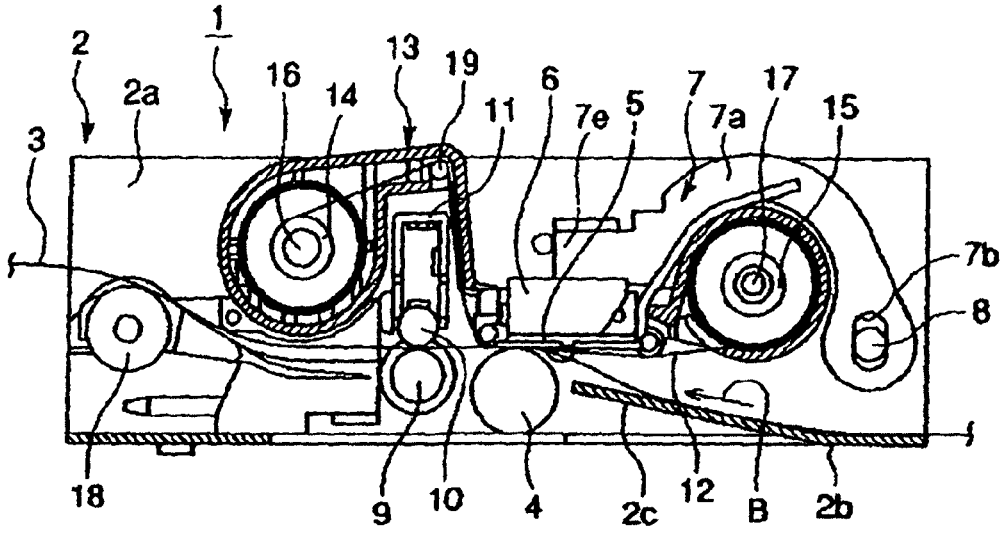
FIG. 1 is a cross-sectional view illustrating an important part of a thermal printer in accordance with the present invention.
Figure 2:
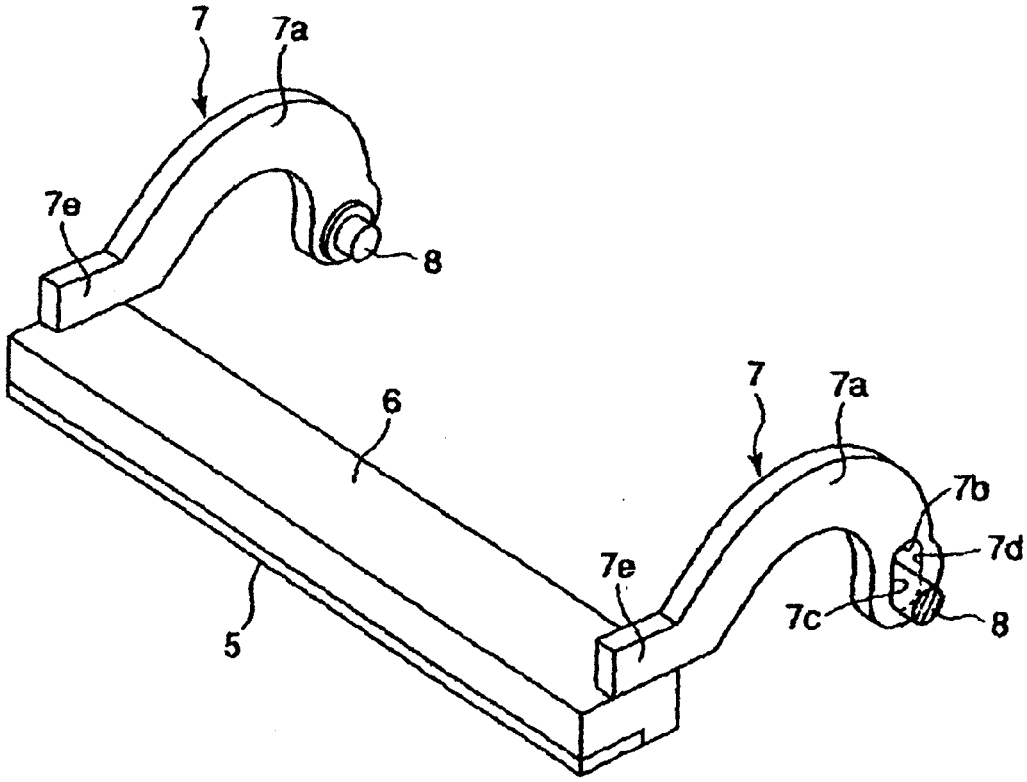
FIG. 2 is a perspective view illustrating a head supporting member in accordance with the present invention.
Figure 3:
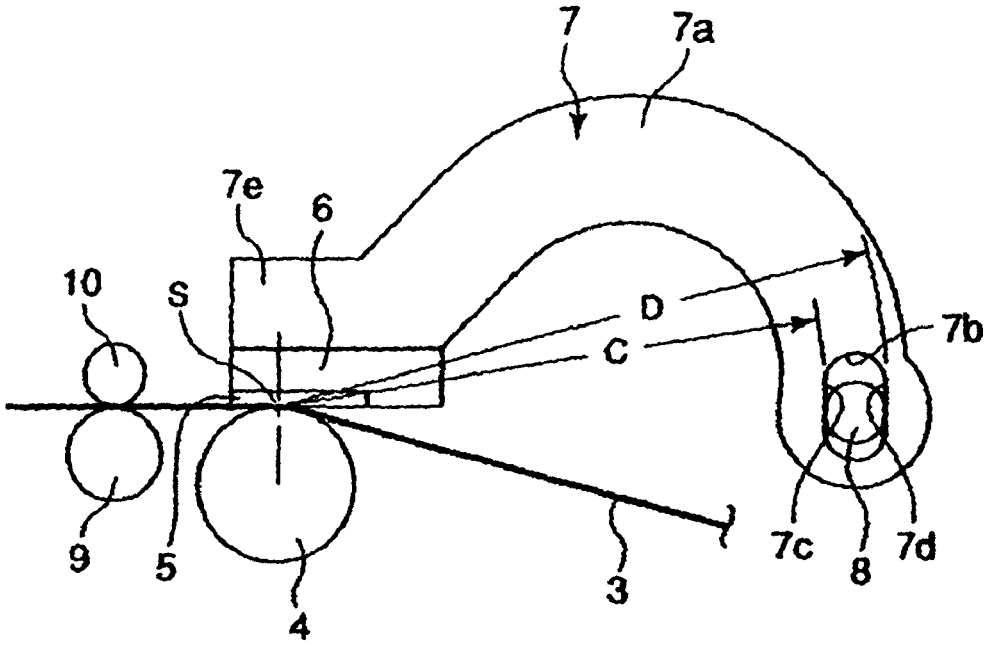
FIG. 3 is a schematic view illustrating the operation of the head supporting member in accordance with the present invention.
Figure 4:
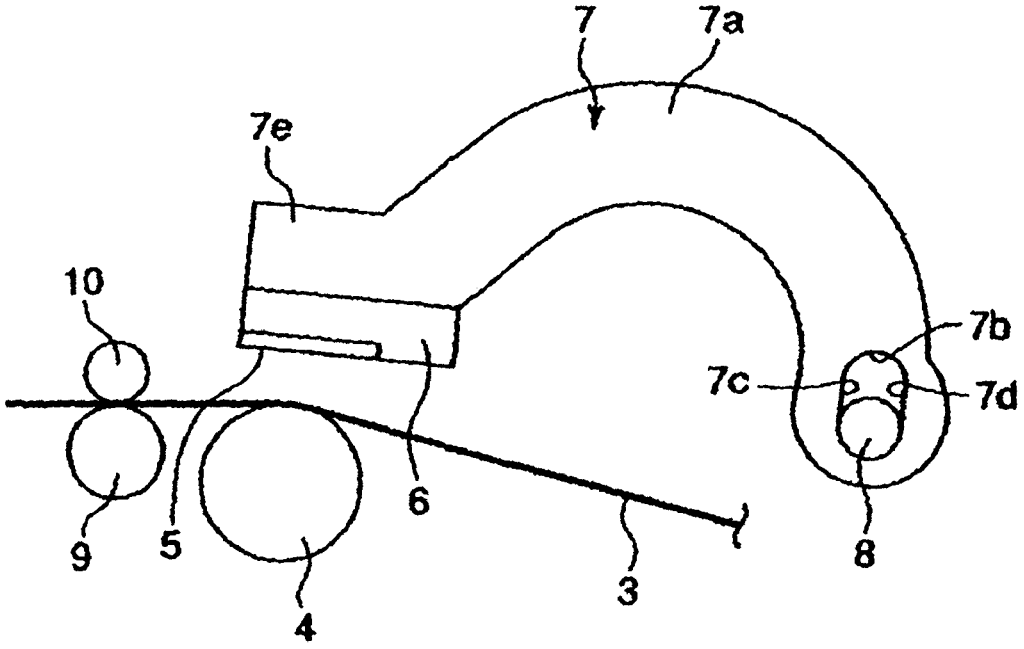
FIG. 4 is a schematic view illustrating the operation of the head supporting member in accordance with the present invention.
Figure 5:
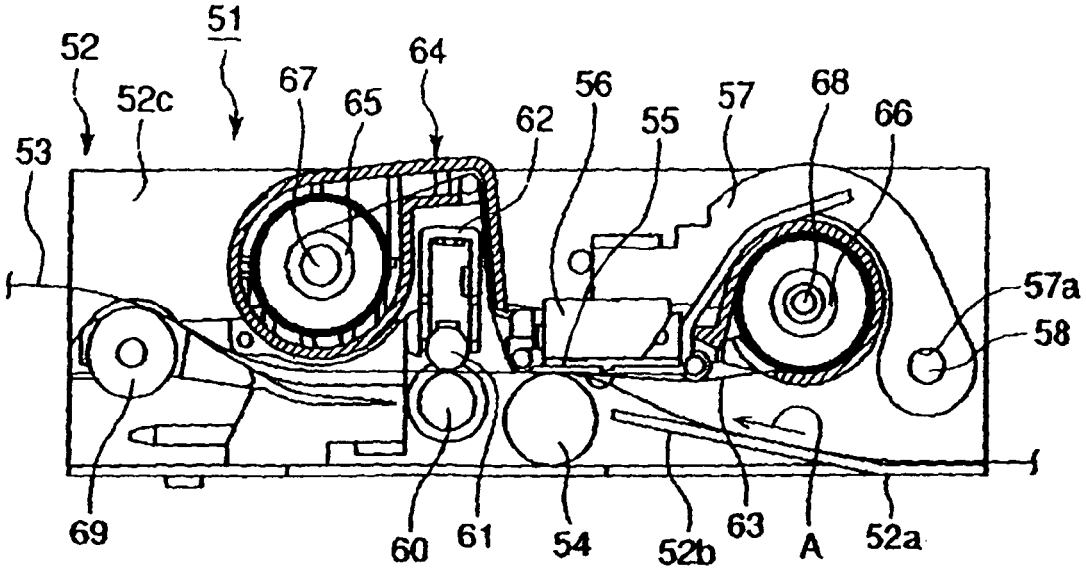
FIG. 5 PRIOR ART
FIG. 5 is a cross-sectional view illustrating an important part of a conventional thermal printer.

A thermal printer in accordance with the present invention will now be described with reference to the accompanying drawings. FIG. 1 is a cross-sectional view illustrating an important part of the thermal printer in accordance with the present invention, FIG. 2 is a perspective view illustrating a head supporting member in accordance with the present invention, and FIGS. 3 and 4 are schematic views illustrating the operation of the head supporting member in accordance with the present invention.

As illustrated in FIG. 1, a main body case 2 comprising a pair of side plates 2*a* opposite to each other and a bottom plate 2*b* connecting the bottom portions of the side plates 2*a* is provided in the thermal printer 1.

A paper guide plate 2*c* is slanted with respect to the bottom plate 2*b* of the main body case 2 on the right side of FIG. 1. Recording media 3 of a predetermined size is fed to the paper guide plate 2*c* by a feeding roller (not shown) and is then carried in the feeding direction of arrow B.

A cylindrical platen roller 4, which is elongated in a direction perpendicular to the paper, is rotatably supported to the side plates 2*a* of the main body case 2, which is opposite to each other, on the lower side of the paper guide plate 2*c* in the feeding direction of arrow B.

Furthermore, a thermal head 5 composed of a line head is provided along the longitudinal direction of the platen roller 4 on the upper side of the platen roller 4. A plurality of heating elements (not shown) is aligned on the printing surface of the thermal head 5 facing the platen roller 4. The heating element-forming portion can contact with or separate from the platen roller 4.

The thermal head 5 adheres to a plate-shaped head mount 6. As shown in FIG. 2, both ends of the head mount 6 are supported by head supporting members 7 using screws (not shown).

That is, the pair of head supporting members 7 support both ends of the thermal head 5 in the longitudinal direction with the head mount 6 interposed therebetween.

The head supporting member 7 has a U-shaped arm portion 7*a*, and a rotation supporting portion 7*b* is formed at one end of the right side of the arm portion 7*a*.

As shown in FIG. 2, the rotation supporting portion 7*b* formed in the front head supporting member 7 is formed in a hole shape elongated in a direction parallel to a direction where the thermal head 5 contacts with or separates from the platen roller 4 (up and down directions). In addition, as depicted in FIG. 3, the inner surfaces 7*c* and 7*d* of the head supporting member 7 facing each other are formed in a circular arc shape having the radius of C and D, of which the center is a contact point S of the thermal head 5 and the platen roller 4.

In FIG. 2, a rotation supporting portion of the other head supporting member 7 facing the front head supporting member 7 is formed in a circular shape (not shown) capable of being axially supported by a supporting shaft 8 that will be discussed later.

The pair of head supporting members 7 is provided with head supporting portions 7*e* for supporting the head mount 6 at their other end (left end in FIG. 2).

The rotation supporting portion 7*b* having an elongated hole shape formed in one of the head supporting members 7 and the rotation supporting portion (not shown) having a circular shape formed in the other of the head supporting members 7 are supported by the supporting shafts 8 fixed to the side plates 2*a* of the main body case 2 facing each other. Accordingly, one end of the right side of one head supporting member 7 can be movable in the up and down directions along the rotation supporting portion 7*b*.

In addition, the arm portions 7*a* of the pair of head supporting members 7 apply force to an elastic member (not shown), so that the thermal head 5 supported by the head supporting portions 7*e* at the other ends of the head supporting members 7 can make pressure contact with the platen roller 4 using the rotation supporting portion 7*b* in an elongated hole shape and the rotation supporting portion (not shown) in a circular shape, which are supported by the supporting shafts 8, as the centers of rotation.

The head supporting members 7 rotate by lifting or lowering the arm portions 7*a* against the elastic force applied from the elastic member, and the thermal head 5 comes into contact with or separates from the platen roller 4 (head up and down).

A rotatable paper transfer roller 9 and a pressure roller 10 capable of coming into contact with the paper transfer roller 9 are provided on the lower side of the platen roller 4 in the feeding direction of the recording media 3, that is, in the direction of arrow B.

The pressure roller 10 is rotatably supported to a roller supporting case 11 and is pressure-contacted to the paper transfer roller 9 by the elastic force applied from an elastic member (not shown) provided in the roller supporting case 11.

An ink ribbon 12 is wound up between the platen roller 4 and the thermal head 5.

The ink ribbon 12 is accommodated in a ribbon cassette 13 with both its ends wound up on a winding core 14 and a supply core 15, respectively.

The ribbon cassette 13 can be mounted on a cassette mounting portion (not shown) formed in the main body case 2.

A winding bobbin 16 engaged with the winding core 14 and a supply bobbin 17 engaged with the supply core 15 are provided in the cassette mounting portion, and the winding bobbin 16 and the supply bobbin 17 are provided in a cantilever shape on one side plate 2*a* of the main body case 2.

A paper discharge roller 18 for discharging the recording media 3 after printing is provided on the lower side of the winding core 14 in the feeding direction of the recording media 3, that is, in the direction of arrow B.

A pinch roller 19 for curving the winding path of the ink ribbon 12 wound up from the supply core 15 to the winding core 14 in a rectangular shape is provided in the upper portion of the roller supporting case 11 in order to prevent the ink ribbon 12 from coming into contact with the roller supporting case 11.

The printing operation of the thermal printer 1 in accordance with the present invention will now be explained. As shown in FIG. 4, the head supporting members 7 rotate upwardly with the supporting shafts 8 as the centers of rotation to lift the thermal head 5.

In the head-up state of the thermal head 5, the winding core 14 is engaged with the winding bobbin 16, and the supply core 15 is engaged with the supply bobbin 17. Then, the ribbon cassette 13 is mounted on the cassette mounting portion.

Subsequently, The recording media 3 is fed between the thermal head 5 and the platen roller 4 in the feeding direction of arrow B.

The predetermined amount of recording media 3 passing between the thermal head 5 and the platen roller 4 is carried on the lower side of the feeding direction of recording media by the paper transfer roller 9 and the pressure roller 10, and adjustment of the head of recording media is carried out by a paper detecting sensor (not shown). After the adjustment of the head of the recording media 3 is carried out, the head supporting members 7 rotate downwardly to lower the thermal head 5.

The plurality of heating elements of the thermal head 5 comes into pressure contact with the outer circumferential surface of the platen roller 4 with the recording media 3 and the ink ribbon 12 interposed therebetween.

The plurality of heating elements of the thermal head 5 is selectively made to generate heat on the basis of printing information, and the paper transfer roller 9 rotates in a counterclockwise direction to carry the recording media 3 in the direction of arrow B.

Accordingly, the desired color images are printed on the recording media 3. The recording media 3 is externally discharged from the main body case 2 by the rotation of the paper discharge roller 18 in the counterclockwise direction.

In order to print color images on the recording media 3, the thermal printer 1 uses a multi-color ink ribbon (not shown) for sequentially and repeatedly applying at least three primary color inks, such as Y (yellow), M (magenta), and C (cyan), on an area corresponding to one page of the recording media 3.

In the first printing operation, while carrying the recording media 3 press-contacted between the paper transfer roller 9 and the pressure roller 10 in the direction of arrow B, for example, an image of a Y (yellow) color is printed on the recording media 3.

When the Y (yellow) image have been printed, the head supporting members 7 rotate upwardly to lift the thermal head 5, and the paper transfer roller 9 is rotated in the clockwise direction to feed the recording media 3 back in a direction opposite to arrow B.

In the second printing operation, an image of an M (magenta) color is printed on the Y (yellow) image.

In the third printing operation, an image of a C (cyan) color is printed on the M image in the same manner as the second printing operation. As a result, the desired color images can be printed on the recording media 3.

In the thermal printer 1 of the present invention, even if the arm portions 7*a* of the pair of head supporting members 7 have positional errors in the up and down directions or are twisted due to a difference in size between components or an error in assembly, when the thermal head 5 is pressure-contacted to the platen roller 4 in printing, the rotation supporting portion 7*b* having an elongated hole shape formed at one of the head supporting members 7 is movable in the up and down directions with the supporting shaft 8 as the center, corresponding to the twisting of the pair of head supporting members 7.

In the embodiment of the present invention, the inner surfaces 7*c* and 7*d* of the rotation supporting portion 7*b* of one of the head supporting members 7 have been formed in a circular arc shape whose the center is a contact point S of the thermal head 5 and the platen roller 4. However, the inner surfaces 7*c* and 7*d* may be formed in a straight line shape in the up and down directions.

In addition, in the embodiment of the present invention, only one of the head supporting members 7 has been provided with the rotation supporting portion 7*b* having an elongated hole shape. However, the other of the head supporting members 7 can also be provided with the rotation supporting portion having an elongated hole shape.

That is, at least one of the rotation supporting portions of the pair of head supporting members 7 is preferably formed in a hole shape elongated in a direction parallel to a direction where the thermal head 5 contacts with and separates from the platen roller 4.

In accordance with a thermal printer of the present invention, at least one of the rotation supporting portions of the pair of head supporting members is formed in a hole shape elongated in a direction parallel to a direction where the thermal head contacts with or separates from the platen roller. Therefore, even if the pair of head supporting members is twisted due to a difference in size between components or an error in assembly, the thermal head is automatically adjusted by the rotation supporting portion having an elongated hole shape to uniformly pressure-contact with the platen roller.

As a result, high-quality printing can be performed.

In addition, since the rotation supporting portions are axially supported by the supporting shafts fixed to the main body case, it is possible to automatically adjust the thermal head to pressure-contact with the platen roller by supporting the rotation supporting portions of the head supporting members using the supporting shafts.

Therefore, the thermal head can uniformly pressure-contact with the platen roller.

Furthermore, the thermal head supported by the head supporting members can uniformly pressure-contact with the platen roller by the elastic force applied from the elastic member. Therefore, even if the thickness of recording media is irregular, the thermal head can uniformly pressure-contact with the recording media regardless of such irregularity.

Moreover, the inner surfaces of the elongated hole shaped rotation supporting portion facing each other in the length direction are formed in a circular arc shape of which the center is a contact point of the thermal head and the platen roller. Therefore, it is possible to automatically adjust the thermal head to pressure-contact with the platen roller.

What is claimed is:

1. A thermal printer comprising:

a platen roller whose shaft is rotatably supported to a main body case;

a thermal head composed of a long line head and capable of contacting with or separating from the platen roller; and a pair of head supporting members for supporting both ends of the thermal head in a longitudinal direction;

a rotation supporting portion configured to rotate the head supporting members supporting the thermal head; and at least one hole shape, elongated in a direction parallel to a direction in which the thermal head contacts or separates from the platen roller, in the rotation supporting portions of the pair of head supporting members;

wherein inner surfaces of the elongated hole shaped rotation supporting portion facing each other in the longitudinal direction are formed in a circular arc shape whose center is a contact point of the thermal head and the platen roller.

2. The thermal printer according to claim 1, wherein the rotation supporting portions are supported by supporting shafts fixed to the main body case.

3. The thermal printer according to claim 1, wherein the thermal head is pressure-contacted to the platen roller by the elastic force applied from an elastic member to the head supporting members.

4. The thermal printer according to claim 2, wherein the thermal head is pressure-contacted to the platen roller by the elastic force applied from an elastic member to the head supporting members.

* * * * *